US010018009B2

(12) United States Patent
Kroesen

(10) Patent No.: US 10,018,009 B2
(45) Date of Patent: Jul. 10, 2018

(54) LOCKING APPARATUS

(71) Applicant: Cameron International Corporation, Houston, TX (US)

(72) Inventor: Gerrit Kroesen, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/632,259

(22) Filed: Feb. 26, 2015

(65) Prior Publication Data

US 2016/0251927 A1 Sep. 1, 2016

(51) Int. Cl.
*E21B 33/06* (2006.01)
*F15B 15/26* (2006.01)

(52) U.S. Cl.
CPC ..... *E21B 33/062* (2013.01); *F15B 15/261* (2013.01)

(58) Field of Classification Search
CPC ..... E21B 33/062; E21B 33/063; F15B 15/26; F15B 15/261; F15B 15/262; F15B 15/264; F15B 2015/268; F15B 2015/267
USPC ..... 251/1.3, 1.1, 284–288, 86–116; 92/15–28; 166/85.4
See application file for complete search history.

(56) References Cited

U.S. PATENT DOCUMENTS 2,632,425 A * 3/1953 Grover ..... B65H 63/0364 92/110
2,782,766 A * 2/1957 Bodem ..... F15B 15/261 92/17
3,242,826 A * 3/1966 Smith ..... E21B 33/062 92/24
3,251,278 A * 5/1966 Royster ..... F15B 15/261 285/920
3,874,480 A * 4/1975 Porter ..... B60N 2/23 188/67
3,905,279 A * 9/1975 Yadon ..... F15B 13/01 92/110
3,918,346 A * 11/1975 Ziegler ..... F41F 1/06 188/170
3,941,141 A * 3/1976 Robert ..... E21B 33/064 137/1
4,045,081 A * 8/1977 Ueno ..... A47C 1/032 297/317
4,052,995 A 10/1977 Ellison
(Continued)

FOREIGN PATENT DOCUMENTS

DE 10324838 A1 12/2004
DE 112004002838 T5 3/2007
(Continued)

OTHER PUBLICATIONS

International Search Report for Application No. PCT/EP2004/007948 dated Feb. 12, 2004 (3 p.).
(Continued)

*Primary Examiner* — Reinaldo Sanchez-Medina
*Assistant Examiner* — David Colon Morales
(74) *Attorney, Agent, or Firm* — Helene Raybaud

(57) ABSTRACT

An apparatus includes a blowout preventer housing, a ram movable within the blowout preventer housing. The apparatus further including a rod configured to move the blowout preventer ram and including an outer surface and a piston configured to move the rod. A friction assembly is configured to engage the outer surface of the rod and prevent movement of the rod and the ram when engaged.

16 Claims, 6 Drawing Sheets

(56) References Cited

U.S. PATENT DOCUMENTS 4,188,860 A * 2/1980 Miller ..... F15B 15/261 92/15
4,189,950 A * 2/1980 Killian ..... F16H 25/2025 74/89.38
4,201,096 A * 5/1980 Morrison ..... G05G 1/12 188/166
4,276,003 A 6/1981 Perkins et al.
4,290,577 A * 9/1981 Olson ..... E21B 33/063 251/1.3
4,305,565 A * 12/1981 Abbe ..... E21B 33/063 251/1.3
4,425,987 A * 1/1984 Porter ..... F16B 7/0406 188/67
4,519,571 A * 5/1985 Jones ..... E21B 33/062 251/1.3
4,523,639 A * 6/1985 Howard, Jr. ..... E21B 29/08 166/323
4,543,649 A * 9/1985 Head ..... B60G 17/01933 367/902
4,712,471 A * 12/1987 Johnson ..... F15B 15/261 92/24
4,840,346 A * 6/1989 Adnyana ..... E21B 33/062 166/363
4,922,423 A * 5/1990 Koomey ..... E21B 33/063 166/373
4,969,390 A * 11/1990 Williams, III ..... B23Q 1/28 251/1.1
5,025,708 A * 6/1991 Smith ..... F15B 15/261 92/19
5,046,376 A 9/1991 Baker
5,056,418 A * 10/1991 Granger ..... F15B 15/261 251/1.1
5,301,505 A 4/1994 Wright
5,349,894 A * 9/1994 Greer ..... F15B 15/26 91/392
5,358,035 A 10/1994 Grudzinski
5,361,680 A * 11/1994 Matsui ..... F15B 11/0365 91/419
5,575,452 A * 11/1996 Whitby ..... E21B 33/063 251/1.3
5,918,851 A * 7/1999 Whitby ..... E21B 33/062 251/1.1
6,568,476 B1 5/2003 Andersen
6,843,463 B1 * 1/2005 McWhorter ..... E21B 33/062 137/601.2
6,907,961 B2 * 6/2005 Allen ..... F16D 63/008 188/67
7,195,224 B2 * 3/2007 Le ..... F15B 15/261 251/1.3
7,300,033 B1 11/2007 Whitby et al.
8,444,109 B2 * 5/2013 Schaeper ..... E21B 33/062 166/85.4
2006/0169933 A1 8/2006 Le
2006/0278406 A1 * 12/2006 Judge ..... E21B 33/062 166/386
2008/0196888 A1 8/2008 Arnold
2009/0127482 A1 * 5/2009 Bamford ..... E21B 33/063 251/1.3
2010/0152901 A1 * 6/2010 Judge ..... E21B 33/062 700/275
2012/0000646 A1 * 1/2012 Liotta ..... E21B 33/062 166/85.4
2012/0055679 A1 * 3/2012 Van Winkle ..... E21B 33/0355 166/363
2013/0283917 A1 * 10/2013 Coonrod ..... E21B 33/061 73/597
2013/0283919 A1 10/2013 Coonrod et al.
2014/0021381 A1 1/2014 Jurena et al.
2014/0084192 A1 * 3/2014 Shimonek ..... F15B 15/261 251/1.3
2014/0251468 A1 * 9/2014 Biester ..... E21B 33/062 137/553

FOREIGN PATENT DOCUMENTS

EP 0433649 A1 6/1991
EP 0458457 A2 * 11/1991 ..... E05C 17/30
EP 0965764 A2 * 12/1999 ..... F15B 15/262
EP 1280977 B1 7/2013
WO 95/08860 A1 3/1995
WO 01/65061 A1 9/2001
WO 2005/015019 A1 2/2005
WO 2011006519 A1 1/2011

OTHER PUBLICATIONS

International Search Report for Application No. PCT/US2006/16130 dated Feb. 1, 2007 (3 p.).
International Search Report and Written Opinion dated Feb. 21, 2012 for Application No. PCT/EP2011/002859 filed Jun. 10, 2011 (10 p.).
International Search Report and Written Opinion issued in corresponding application No. PCT/US2016/017962 dated Oct. 12, 2016, 11 pgs.

* cited by examiner

LOCKING APPARATUS

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

More particularly, wellhead assemblies often include a blowout preventer, such as a ram-type blowout preventer that uses one or more pairs of opposing rams that press against one another to restrict flow of fluid through the blowout preventer. The rams typically include main bodies (or ram blocks) that receive sealing elements (or ram packers) that press together when a pair of opposing rams close against one another. Often, the rams are driven into and out of a main bore of a blowout preventer by operating pistons coupled to the rams by connecting rods. In a common design, a ram block includes a slot for receiving a button on the end of a rod, which allows the operating piston and connecting rod to push and pull the ram block within the blowout preventer. A locking device may also be used to lock the rams in position within the blowout preventer.

BRIEF DESCRIPTION OF THE DRAWINGS

For a detailed description of embodiments of the subject disclosure, reference will now be made to the accompanying drawings in which.

DETAILED DESCRIPTION

Figure 1:
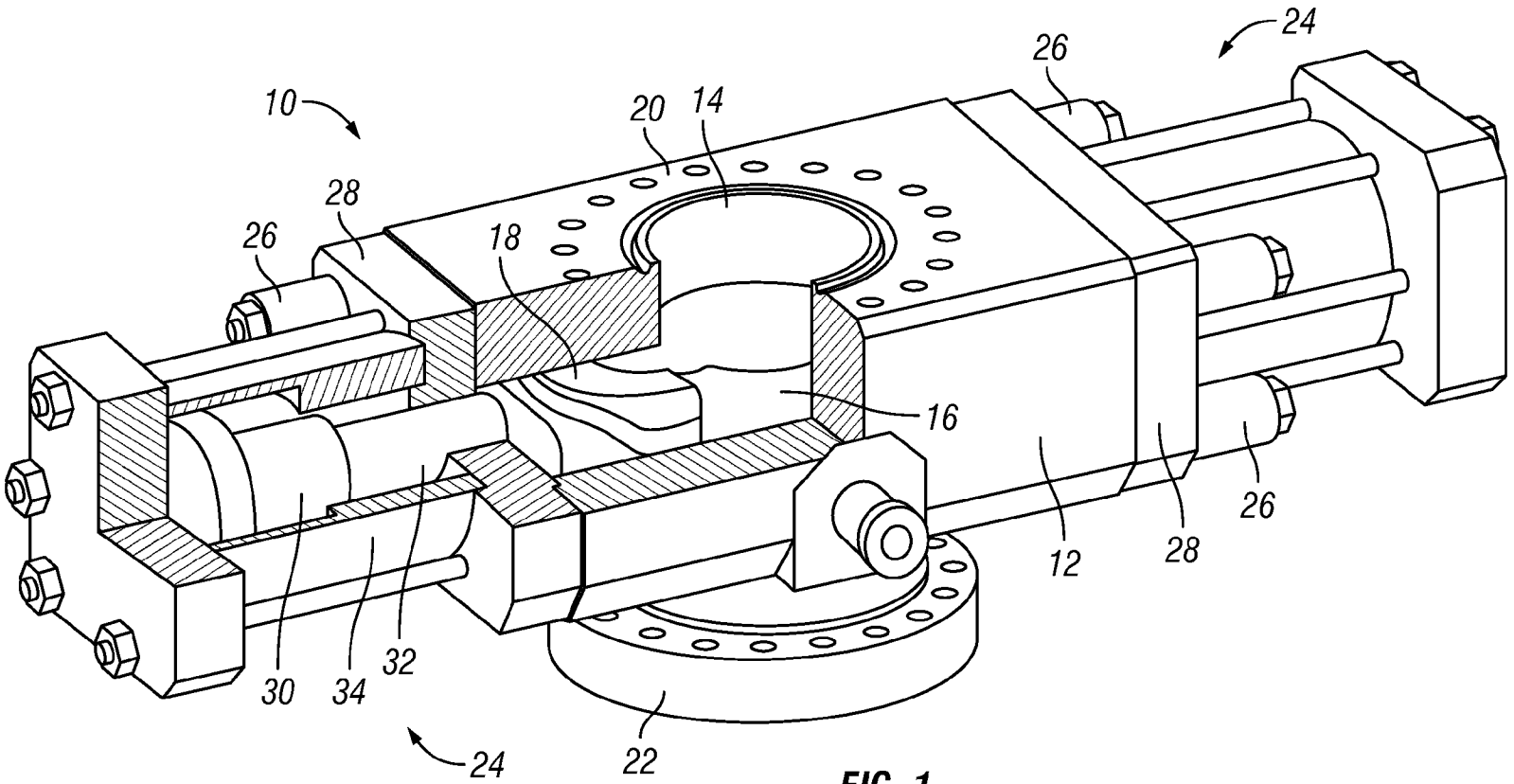
FIG. 1 shows a sectional view of a blowout preventer in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Referring now to FIG. 1, a sectional view of a blowout preventer 10 is shown. The blowout preventer 10 includes a housing 12, such as a hollow body, with a bore 14 that enables passage of fluid or tubular member through the blowout preventer 10. The housing 12 further includes one or more cavities 16, such as cavities 16 opposed from each other with respect to the bore 14, with a ram 18 movably positioned within each cavity 16. The blowout preventer 10 may be coupled to other equipment that facilitates natural resource production. For instance, production equipment or other components may be attached to the top of the blowout preventer 10 using a connection 20 (which may be facilitated in the form of fasteners), and the blowout preventer 10 may be attached to a wellhead or spool using the flange 22 and additional fasteners.

One or more bonnet assemblies 24 are secured to the housing 12 and include various components that facilitate control of the rams 18 positioned in the blowout preventer 10. The bonnet assemblies 24 are coupled to the housing 12 by using one or more fasteners 26 to secure the bonnets 28 of the bonnet assemblies 24 to the housing 12. The rams 18 are then actuated and moved through the cavities 16, into and out of the bore 14, by operating and moving a piston 30 and a rod 32 coupled thereto or a part thereof within a housing 34 of the bonnet assemblies 24. In operation, a force (e.g., from hydraulic pressure) may be applied to the pistons 30 to drive the rods 32, which in turn drives the rams 18 into the bore 14 of the blowout preventer 10. The rams 18 cooperate with one another when driven together to seal the bore 14 and inhibit flow through the blowout preventer 10.

Figure 2:
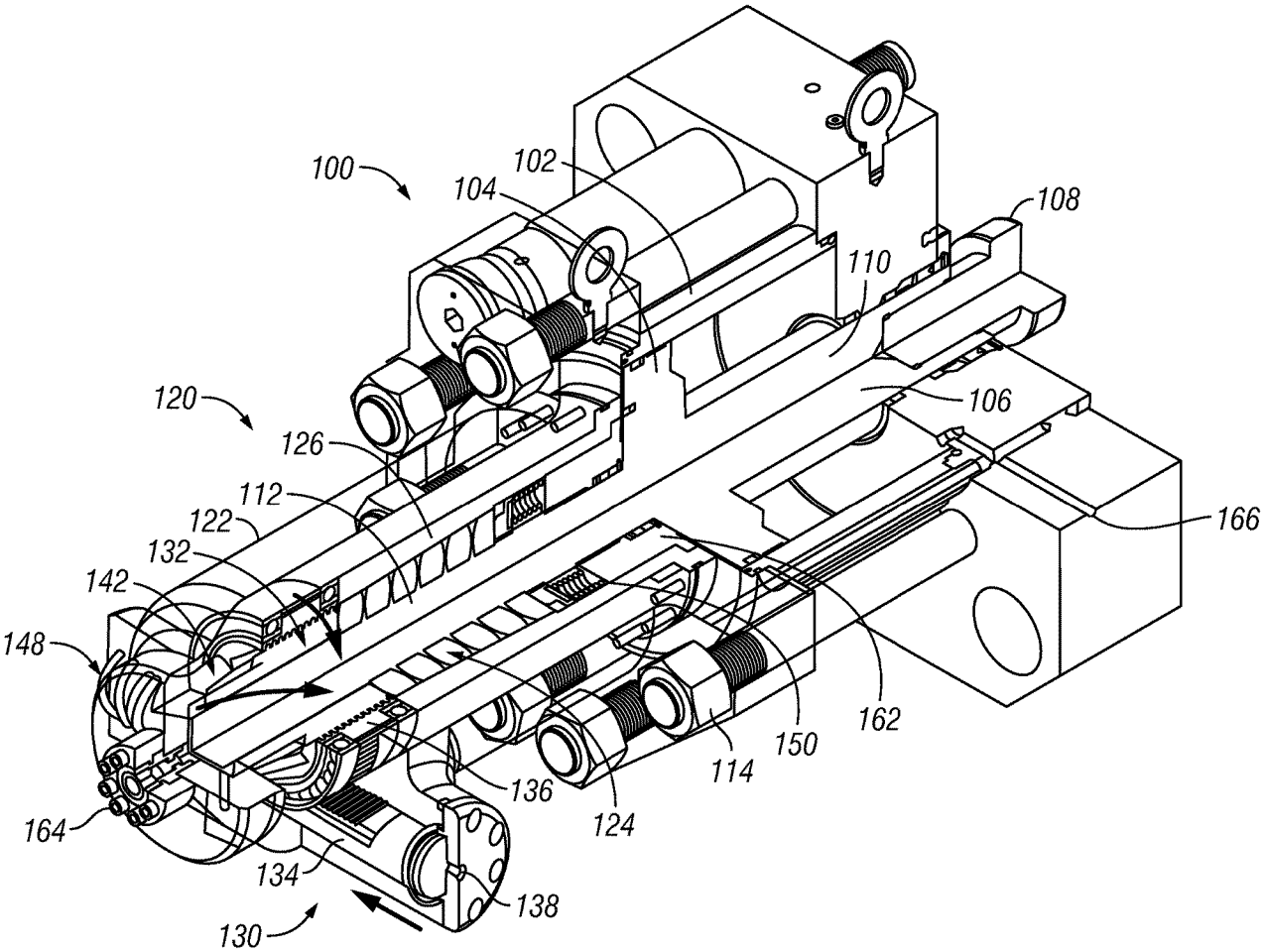
FIG. 2 shows a sectional perspective view of a bonnet assembly in accordance with one or more embodiments of the present disclosure.
Figure 3:
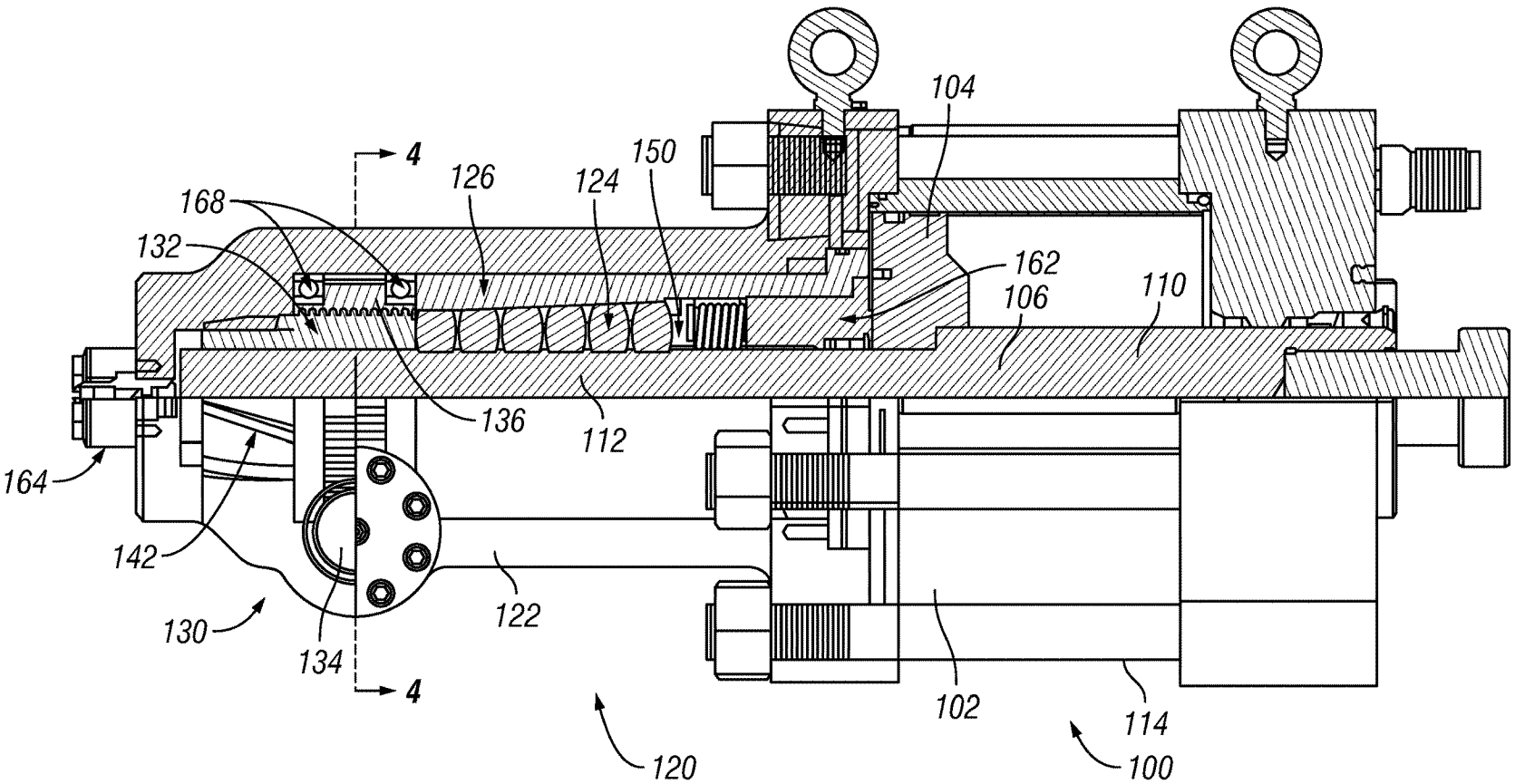
FIG. 3 shows a sectional side view of a bonnet assembly in accordance with one or more embodiments of the present disclosure.

Referring now to FIGS. 2 and 3, multiple sectional views of a bonnet assembly 100 in accordance with one or more embodiments of the present disclosure are shown. FIG. 2 shows a sectional perspective view of the bonnet assembly 100, and FIG. 3 shows a sectional side view of the bonnet assembly 100. As with the above, the bonnet assembly 100 includes a housing 102 with a piston 104 movably positioned within the housing 102, and a rod 106 coupled to or integral with the piston 104. The rod 106 also couples with a ram, such as by receiving a button 108 on an end of the rod 106 within a slot of the ram, to enable the piston 104 and the rod 106 to move the ram within a blowout preventer. In particular, the rod 106 may include a portion that is a connecting rod 110 extending from the piston 104 towards the ram, and may include a portion that is a tail rod 112 extending from the piston away from the ram, opposite the connection rod 110. Further, those having ordinary skill in the art will appreciate that other configurations and embodiments may be used to couple the rod 106 to a ram without departing from the scope of the present disclosure.

In one or more embodiments, a friction assembly 120 may be used to prevent movement of the piston 104, the rod 106, and the ram, such as when desired to lock the ram in a relative position within a blowout preventer. As shown, the friction assembly 120 is coupled and secured to the bonnet assembly 100 using fasteners 114. The friction assembly 120 engages a cylindrical outer surface of the rod 106, and more particularly a cylindrical outer surface of the tail rod 112 in this embodiment, to prevent movement of the rod 106 with respect to the friction assembly 120. Although the friction assembly 120 and components thereof may be discussed with respect to engaging the tail rod 112, the present disclosure is not so limited. Other embodiments are included within the scope of the present disclosure that may include engaging other portions of the rod 106.

The friction assembly 120 includes a housing 122, such as a cylindrical housing, coupled to bonnet assembly 100. The rod 106, such as the tail rod 112 in this embodiment, may extend through the housing 122. The friction assembly 120 includes a friction device 124 positioned within the housing 122, and more particularly may be positioned between the housing 122 (e.g., cylindrical inner surface of the housing 122) and the tail rod 112 (e.g., cylindrical outer surface of the tail rod 112).

In this embodiment, the friction device 124 includes a coil element, in which the coil element is positionable about the tail rod 112 such that the tail rod 112 extends, at least partially, through the coil element. When in a relaxed state (e.g., in the engaged position), an inner diameter of the coil element may be smaller than an outer diameter of the tail rod 112, which may enable the coil element to engage the tail rod 112. For example, in the engaged position, the inner diameter of the coil element may be about 0.001-0.01 in (0.025-0.25 mm) smaller than the outer diameter of the tail rod 112, and more particularly may be about 0.001-0.002 in (0.025-0.051 mm) smaller than the outer diameter of the tail rod 112. The coil element may then be moved and/or have a force applied thereto to contract the coil element (e.g., in the disengaged position) such that the inner diameter of the coil element may be larger than that of the outer diameter of the tail rod 112, which may enable the coil element to disengage the tail rod 112. For example, in the disengaged position, the inner diameter of the coil element may be about 0.001-0.01 in (0.025-0.25 mm) larger than the outer diameter of the tail rod 112, and more particularly may be about 0.001-0.002 in (0.025-0.051 mm) larger than the outer diameter of the tail rod 112.

Figure 5:
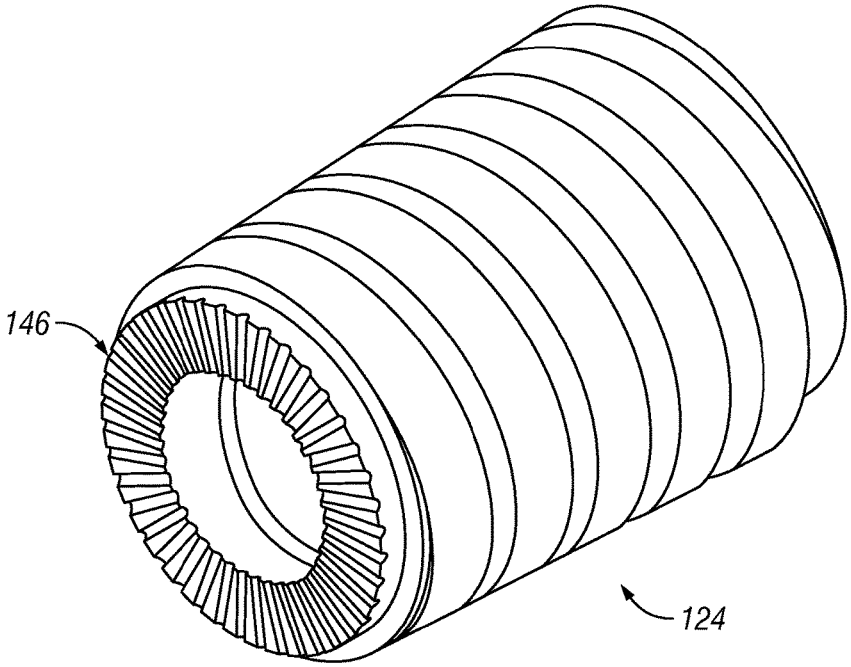
FIG. 5 shows a perspective front view of a coil element in accordance with one or more embodiments of the present disclosure.
Figure 6:
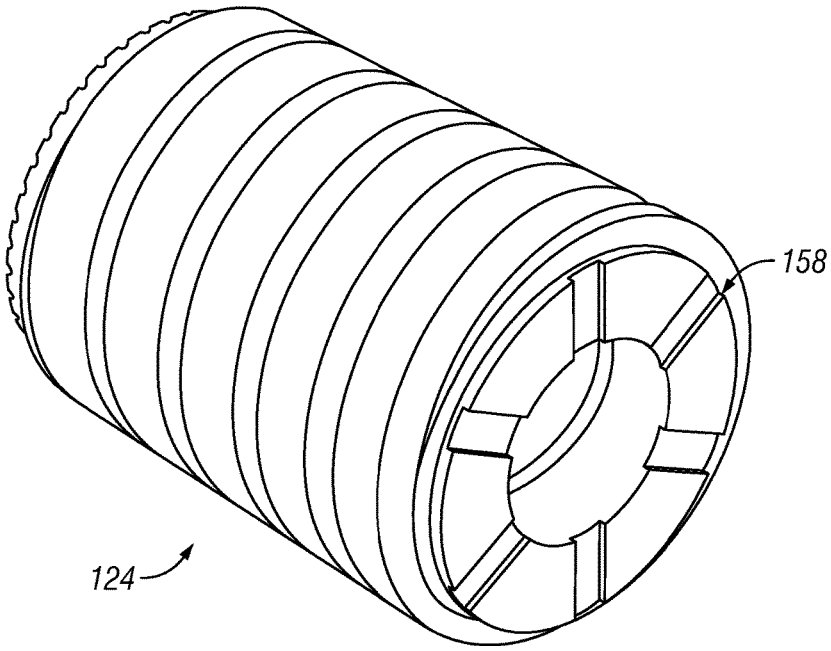
FIG. 6 shows a perspective back view of a coil element in accordance with one or more embodiments of the present disclosure.

In one or more embodiments, a tapered surface is included or formed between the friction device 124 and the housing 122 of the friction assembly 120 to facilitate engagement between the friction device 124 and the housing 122. For example, the friction assembly housing 122 may include a tapered inner diameter, and, as shown in FIGS. 5 and 6, the coil element may include a corresponding tapered outer diameter. The taper of the outer diameter of the coil element may extend away from a bore of a blowout preventer such that the outer diameter of the coil element is larger at an end positioned closer to the blowout preventer and smaller at an end positioned further away from the blowout preventer. This may enable the tapered surfaces to engage against each other from a force received from a ram of the blowout preventer through the rod 106 of the bonnet assembly 100.

Further, in this embodiment, the housing 122 of the friction assembly 120 may include friction device housing 126. The friction device housing 126 may be positioned within and concentric with the friction assembly housing 122, with the friction device (e.g., coil element) positioned within the friction device housing 126. Such an embodiment may enable the tapered surface the friction device housing 126 to include the tapered inner diameter in addition or in alternative to the friction assembly housing 122. In the event that the tapered inner diameter then wears and needs replacement, the friction device housing 126 may then be removed and replaced, as opposed to having to replace the entire friction assembly housing 126.

Referring still to FIGS. 2 and 3, the friction assembly 120 may further include an actuation assembly 130 to move the friction device 124 between an engaged position and a disengaged position to selectively engage the cylindrical outer surface of the tail rod 112. The friction device 124 selectively engages the cylindrical outer surface of the tail rod 112 to prevent movement of the tail rod 112 with respect to the housing 122. In the engaged position, the friction device 124 engages (e.g., frictionally engages) the cylindrical outer surface of the tail rod 112 to prevent movement of the tail rod 112 with respect to the housing 122. In the disengaged position, the friction device 124 disengages (e.g., frictionally disengages) the cylindrical outer surface of the tail rod 112 to enable movement of the tail rod 112 with respect to the housing 122.

In this embodiment, the actuation assembly 130 applies an axial force and/or a rotational force to the friction device to move the friction device between the engaged position and the disengaged position. For example, the actuation assembly 130 may include an engagement member 132, such as a friction device pusher shown in FIG. 7, to apply an axial force and/or rotational force to the friction device 124.

Figure 4:
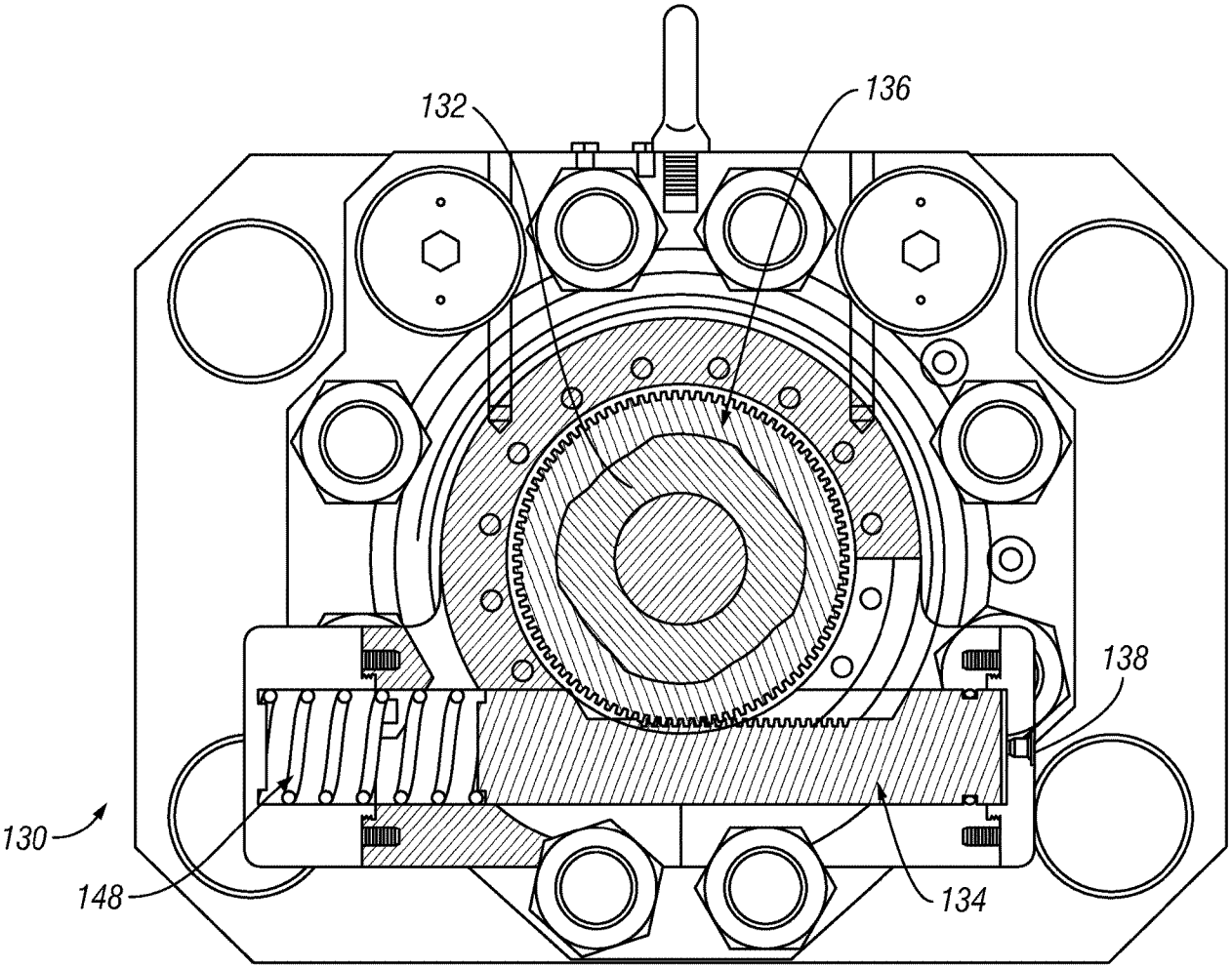
FIG. 4 shows a cross-sectional view taken along line A-A of FIG. 3 in accordance with one or more embodiments of the present disclosure.

A rack 134 and a pinion 136 control and actuate movement of the engagement member 132 to apply an axial force and/or rotational force to the friction device 124. FIG. 4 shows a cross-sectional view taken along line A-A of FIG. 3 for a more detailed view of the actuation assembly 130. A force may be applied to the rack 134 (e.g., hydraulic pressure introduced through an inlet or port 138) to move the rack 134, as indicated by the direction arrow in FIG. 2. This force and movement may enable the rack 134 to impart rotational movement to the pinion 136, as also indicated by the direction arrow in FIG. 2, through engagement of teeth between the rack 134 and the pinion 136. One or more bearings 168 may then be used to facilitate rotation of the pinion 136 within the housing 122 of the friction assembly 120.

The pinion 136 and the engagement member 132 may be threadedly engaged with each other through a thread 140 included on the engagement member 132. The engagement of the pinion 136 with the thread 140 of the engagement member 132 may enable the engagement member 132 to move axially with respect to the pinion 136. Further, the engagement member 132 may include one or more rotational guides 142. The rotational guides 142 may engage with corresponding rotational guides or surfaces included within the housing 122 of the friction assembly 120. The engagement of the rotational guides 142 of the engagement member 132 with the rotational guides of the housing 122 may enable the engagement member 132 to move rotationally with respect to the housing 122. This axial and rotational movement of the engagement member 132 is indicated by the direction arrow in FIG. 2.

Figure 7:
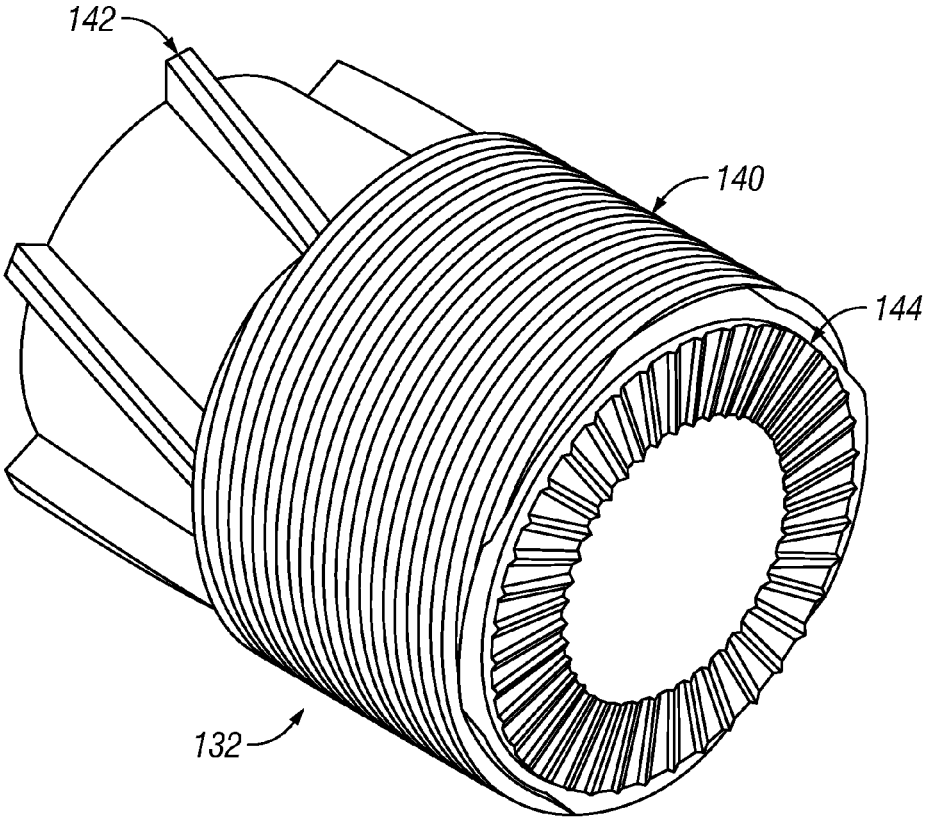
FIG. 7 shows a perspective front view of an engagement member in accordance with one or more embodiments of the present disclosure.

Further, as shown particularly in FIGS. 5 and 7, the engagement member 132 may include an engagement face 144 (e.g., clutch face) and the friction device 124 may include a corresponding engagement face 146. As the engagement member 132 axially and rotationally moves with respect to the housing 122, the engagement of the engagement face 144 of the engagement member 132 and the engagement face 146 of the friction device 124 may enable the engagement member 132 to apply an axial force and a rotational force to the friction device 124, thereby moving the friction device 124 between the engaged position and the disengaged position.

As shown with respect to FIGS. 2-4, the actuation assembly 130 may be actuated to apply an axial force and/or a rotational force to the friction device 124. To disengage the friction device 124, hydraulic pressure is introduced through the port 138 to move the rack 134 in the direction of the arrow shown, thereby moving the engagement member 132 axially and rotationally. The axial and rotational movement of the engagement member 132 is translated to the friction device 124 to move the friction device 124 axially and rotationally as well, thus moving the friction device 124 from the engaged position to the disengaged position.

To move the friction device 124 to the engaged position, hydraulic pressure may be relieved from the port 138 to allow the rack 134 to move back, thereby moving the engagement member 132 back axially and rotationally and moving the friction device 124 from the disengaged position to the engaged position. Further, the actuation assembly 130 may be biased towards the friction device 124 being the engaged position. For example, a biasing mechanism 148, such as a spring, may be used to create a biasing force against the rack 134 to bias the actuation assembly 130. Additionally or alternatively, the friction device 124, such as the coil element, may also create a biasing force against the engagement member 132 to move from an unrelaxed state to a relaxed state, to bias the actuation assembly 130.

Figure 8:
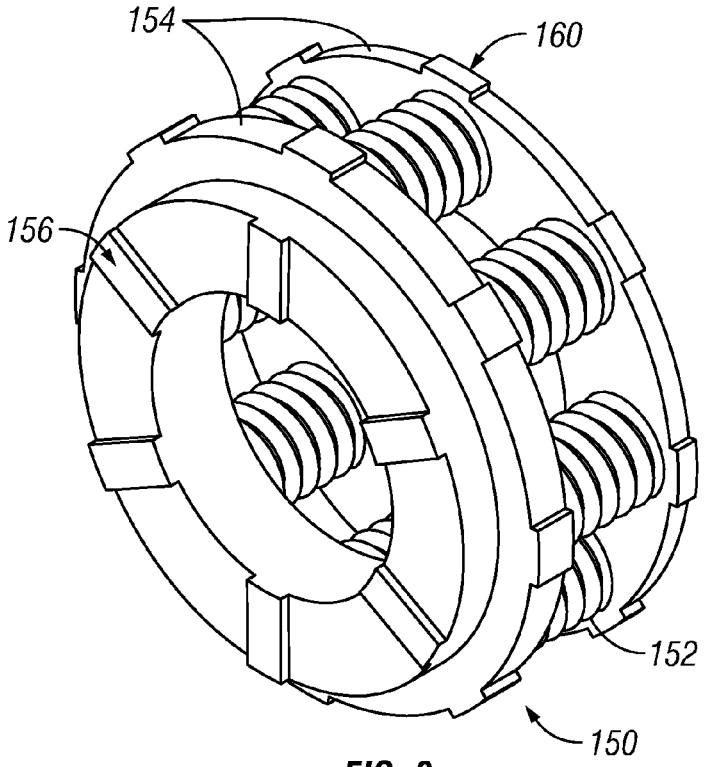
FIG. 8 shows a perspective front view of a biasing mechanism in accordance with one or more embodiments of the present disclosure.

Referring now to FIGS. 2, 3, and 8, the friction assembly 120 may include a biasing mechanism 150 to bias the friction device 124 from the disengaged position towards the engaged position. In this embodiment, the biasing mechanism 150 includes one or more biasing elements 152 (e.g., springs) positioned between plates 154. The biasing mechanism 150 may be positioned within the housing 122 of the friction assembly 120 to bias the friction device 124 against the engagement member 132 of the actuation assembly 130, and to bias the tapered outer diameter of the friction device 124 into engagement with the tapered inner diameter of the friction device housing 126 (or the housing 122 if the friction device housing 126 is not present). The biasing mechanism 150 may include an engagement face 156 (e.g., lugs included on the plate 154) to engage a corresponding engagement face 158 (e.g., slots) of the friction device 124. This may enable the engagement faces 156 and 158 to prevent relative rotation therebetween. Further, the biasing mechanism 150 may include one or more anti-rotation members 160 (e.g., lugs) to engage with one or more corresponding anti-rotation members (e.g., slots) included within the friction device housing 126 (or the housing 122 if the friction device housing 126 is not present) to prevent rotation between the biasing mechanism and the friction device housing 126.

One or more seals may be used to facilitate the use of the friction assembly 120 with the bonnet assembly 100. For example, with reference to FIGS. 2 and 3, a seal assembly 162 may be positioned within the housing 122 and between the friction device housing 126 (or the housing 122 if the friction device housing 126 is not present) and the tail rod 112. This may enable the seal assembly 162 to create a dynamic seal against the tail rod 112 and prevent hydraulic fluid from entering from the bonnet assembly 100 into the friction assembly 120.

Referring still to FIGS. 2 and 3, a sensor 164 may be used to measure a position of the piston 104 and/or the rod 106 within the bonnet housing 102. For example, as shown, the sensor 164 may be coupled to the friction device housing 122, such as positioned at an end of the housing 122. The sensor 164 sends a signal into the friction device housing 122 that reflects off an end of the rod 106, with the sensor 164 then receiving the reflection of the signal. The same sensor 164 may both send the signal and receive the reflection of the signal (as opposed to the use of multiple sensors) because the end of the rod 106 may be flat and perpendicular to the trajectory of the signal sent by the sensor 164. Based upon this reflected signal, the sensor 164 may determine a position of the end of the rod 106 with respect to the position of the sensor 164, thereby enabling the position of the piston 104 and/or the rod 106 within the bonnet housing 102 to be calculated or determined.

In one or more embodiments, the bonnet assembly 100 may be linked with the friction assembly 120 such that, when the piston 104 and the rod 106 are moving within the bonnet assembly housing 102 (or hydraulic pressure applied thereto to move the piston 104), the friction assembly 120 may disengage the rod 106 to enable the movement of the piston 104 and the rod 106 within the bonnet assembly housing 102. Otherwise, the friction assembly 120 may remain engaged with the rod 106 to prevent movement of the piston 104 and the rod 106 within the bonnet assembly housing 102, particularly in the event that the blowout preventer coupled to the bonnet assembly 100 is used to regulate pressure of a well and/or prevent a blowout.

For example, one or more ports 166 used to control movement of the piston 104 within the bonnet assembly housing 102 may be hydraulically coupled to (e.g., on the same hydraulic circuit as) the port 138 of the actuation assembly 130. In such an embodiment, when hydraulic pressure is introduced into the ports 166, hydraulic pressure may also be introduced into the port 138. This may enable the actuation assembly 130 to move from the disengaged position to the engaged position, thereby moving the friction device 124 from the engaged position to the disengaged position to disengage the cylindrical outer surface of the rod 106 (e.g., tail rod 112 in this embodiment). Once the friction device 124 is disengaged from the cylindrical outer surface of the rod 106, the rod 106 and the piston 104 coupled thereto are free to move within the housing 102 of the bonnet assembly 100 and be controlled by hydraulic pressure introduced through the ports 166. Once hydraulic pressure is no longer introduced or supplied to the ports 166, and therefore hydraulic pressure is no longer introduced or supplied to the port 138, the actuation assembly 130 may move from the engaged position to the disengaged position (e.g., automatically), thereby moving the friction device 124 from the disengaged position to the engaged position to engage the cylindrical outer surface of the rod 106 (e.g., tail rod 112 in this embodiment) and prevent movement of the rod 106.

Those having ordinary skill in the art will appreciate that, though in this embodiment the friction assembly is shown as coupled to the exterior of the bonnet assembly, the present disclosure is not so limited. For example, in one or more embodiment, the present disclosure contemplates incorporating the friction assembly within the bonnet assembly, such as by including the friction assembly within the housing of the bonnet assembly. Accordingly, the present disclosure contemplates other embodiments, arrangements, and configurations than only those shown in the figures.

Although the present invention has been described with respect to specific details, it is not intended that such details should be regarded as limitations on the scope of the invention, except to the extent that they are included in the accompanying claims.

What is claimed is:

1. An apparatus, comprising:
- a blowout preventer housing;
- a blowout preventer ram moveable within the housing;
- a rod configured to move the blowout preventer ram and comprising an outer surface;
- a piston configured to move the rod; and
- a friction assembly comprising:
  - a coil element positioned around the rod and movable between an engaged position to engage the outer surface of the rod to prevent movement of the rod and the ram, and a disengaged position to disengage the outer surface of the rod to enable movement of the rod and the ram; and
  - an actuation assembly to apply an axial force to the coil element and move the coil element between the engaged position and the disengaged position.

2. The apparatus of claim 1, wherein:
- the rod comprises a connecting rod extending from the piston towards the ram and a tail rod extending from the piston away from the ram; and
- the friction assembly is engageable with an outer surface of the tail rod.

3. The apparatus of claim 1, wherein the friction assembly further comprises:
- a friction assembly housing;
- the coil element positioned within the friction assembly housing; and
- the coil element engageable between the friction assembly housing and the outer surface of the rod to prevent movement of the rod.

4. The apparatus of claim 3, wherein the coil element positioned around the rod is configured to tighten around the outer surface of the rod to engage the rod.

5. The apparatus of claim 4, wherein the friction assembly housing comprises a tapered inner surface and the coil element comprises a tapered outer surface.

6. The apparatus of claim 1, wherein the actuation assembly is biased towards the disengaged position.

7. The apparatus of claim 1, wherein the actuation assembly comprises an engagement member to apply the axial force to the coil element.

8. The apparatus of claim 1, wherein the friction assembly further comprises a biasing mechanism to bias the coil element towards the engaged position.

9. The apparatus of claim 3, wherein the friction assembly further comprises a seal assembly positionable between the friction assembly housing and the rod.

10. The apparatus of claim 1, further comprising a sensor configured to send a signal and receive a reflection of the signal from an end of the rod to measure a position of the rod with respect to the sensor.

11. An apparatus, comprising:
- a housing;
- a rod comprising an outer surface; and
- a piston movable within the housing and configured to move the rod;
- a friction assembly comprising:
  - a coil element positioned around the rod and movable between an engaged position to engage the outer surface of the rod to prevent movement of the rod, and a disengaged position to disengage the outer surface of the rod and enable movement of the rod; and
  - an actuation assembly to apply an axial force to the coil element and move the coil element between the engaged position and the disengaged position.

12. The apparatus of claim 11, wherein:
- the rod is configured to move a blowout preventer ram within a blowout preventer;
- the rod comprises a connecting rod extending from the piston towards the blowout preventer ram and a tail rod extending from the piston away from the blowout preventer ram; and
- the friction assembly engageable with an outer surface of the tail rod.

13. The apparatus of claim 11, wherein the friction assembly further comprises:
- a friction assembly housing;
- the coil element positioned within the friction assembly housing; and
- wherein the coil element is engageable between the friction assembly housing and the outer surface of the rod to prevent movement of the rod when engaged.

14. The apparatus of claim 13, wherein the coil element positioned around the rod is configured to tighten around the outer surface of the rod to engage the rod.

15. The apparatus of claim 11, wherein the actuation assembly comprises an engagement member to apply the axial force to the coil element.

16. The apparatus of claim 11, wherein the friction assembly further comprises a biasing mechanism to bias the coil element towards the engaged position.

* * * * *